US005598001A

United States Patent [19]

Flory et al.

[11] Patent Number: 5,598,001

[45] Date of Patent: Jan. 28, 1997

[54] MASS SELECTIVE MULTINOTCH FILTER WITH ORTHOGONAL EXCISION FIELDS

[75] Inventors: Curt A. Flory, Los Altos; Carl A. Myerholtz, Cupertino, both of Calif.

[73] Assignee: Hewlett-Packard Company, Palo Alto, Calif.

[21] Appl. No.: 593,955

[22] Filed: Jan. 30, 1996

[51] Int. Cl.[6] ..... H01J 49/42

[52] U.S. Cl. ..... 250/292; 250/282

[58] Field of Search ..... 250/292, 291, 250/290, 282

[56] References Cited

U.S. PATENT DOCUMENTS

| | | | |
|---|---|---|---|
| 3,321,623 | 5/1967 | Brubaker et al. | 250/292 |
| 3,334,225 | 8/1967 | Langmuir . | |
| 4,535,236 | 8/1985 | Batey | 250/292 |
| 4,652,753 | 3/1987 | Shiokawa | 250/281 |
| 4,736,101 | 4/1988 | Syka et al. | 250/292 |
| 4,885,500 | 12/1989 | Hansen et al. | 313/256 |
| 5,089,703 | 2/1992 | Schoen et al. | 250/292 |
| 5,177,359 | 1/1993 | Hiroki et al. | 250/292 |
| 5,187,365 | 2/1993 | Kelley | 250/282 |
| 5,227,629 | 7/1993 | Miseki et al. | 250/292 |
| 5,345,078 | 9/1994 | Kelley | 250/282 |
| 5,365,064 | 11/1994 | Rettinghaus | 250/305 |

OTHER PUBLICATIONS

Reinsfelder et al., "Theory and Characterization of a Separator Analyzer Mass Spectrometer", 1981, vol. 37, pp. 241–250, International Journal of Mass Spectrometry and Ion Physics. no month.

Miller et al., "A Notch Rejection Quadrupole Mass Filter", 1990, vol. 96, pp. 17–26, International Journal of Mass Spectrometry and Ion Processes. no month.

*Primary Examiner*—Jack I. Berman
*Attorney, Agent, or Firm*—Philip S. Yip

[57] ABSTRACT

A multinotch filter for selectively removing target ions with a plurality of specific mass-to-charge ratios from an ion beam is disclosed. The multinotch filter uses a quadrupole and a power supply for generating rf voltages in the quadrupole. The quadrupole has two pairs of parallel electrodes. Each pair has two parallel, oppositely facing electrodes. The rf voltages generated by the power supply includes a rf quadrupole frequency component and at least a first excision frequency component and a second excision frequency component. The rf quadrupole frequency component is applied to the electrodes such that within each pair the two oppositely facing electrodes with respect to the rf quadrupole frequency component are equal in potential and the two pairs are 180° out of phase. With respect to the first excision frequency component, the oppositely facing electrodes within one pair are 180° out of phase with each other. With respect to the second excision frequency component, the oppositely facing electrodes within the other pair are 180° out of phase with each other. The quadrupole has an inlet end and an outlet end and the ion beam traverses from the inlet end to the outlet end. As a result of the rf quadrupole frequency component, ions of above a selected mass-to-charge ratio are guided down the quadrupole. The excision frequency components cause target ions of a plurality of specific mass-to-charge ratios to resonate and be removed from the ion beam before exiting the quadrupole.

18 Claims, 10 Drawing Sheets

MASS SELECTIVE MULTINOTCH FILTER WITH ORTHOGONAL EXCISION FIELDS

FIELD OF THE INVENTION

The present invention relates to mass filters, more particularly, to quadrupole mass filters for eliminating ions of specific mass-to-charge ratios.

BACKGROUND

Mass spectrometry (MS) is a useful analytic technique for identification of chemical structures, determination of components of mixtures, and quantitative elemental analysis. This analytical technique is based on the separation of the ionized components of an analyte by their mass-to-charge ratios. Often, in either the collection or ionization stage of a sample for analysis, an undesired species can be present at a very high level in the sample. Examples of undesired species include the background helium carrier gas when using a gas chromatograph column as the input to the mass spectrometer and the residual argon gas found in samples obtained from inductively coupled plasma (ICP) sources. Thus, a mass filter that can selectively eliminate ions of a predetermined mass-to-charge ratio from an ion beam but fully transmit all other ions is desirable.

To this end, filters have been inserted into the path of an ion beam to remove target ions (such as a contaminant, or undesirable ion) of a specified mass-to-charge ratio while transmitting other ions. Preferably, the filter transmission function has a notch only one atomic mass unit wide to allow rejection of a single ion species. Such filters, made by using quadrupoles, have been reported in the literature.

A quadrupole filter is a device in which ions travel along an axis parallel to and centered between four parallel quadrupole rods connected to voltage sources (e.g., described in U.S. Pat. No. 3,334,225 (Langmuir) and No. 5,187,365 (Kelley)). FIG. 1 shows a typical quadrupole 10, which has four parallel, straight, (i.e., linear), elongated electrodes (or rods) 12, 14, 16, 18 connected to an oscillating voltage supply 20 that supplies a radio frequency (rf) oscillating voltage (hereinafter referred to as the "rf quadrupole voltage") to the electrodes. A pair of oppositely facing electrodes 12, 16 are connected to one pole and the other pair of oppositely facing electrodes 14, 18 are connected to the other pole of the voltage supply 20. The rf quadrupole voltage guides ions between the electrodes via well-known effective forces. (The rf frequency, represented by $\Omega$, of this rf quadrupole voltage is referred to as the "rf quadrupole frequency" hereinafter.)

As known in the art, to filter out an unwanted contaminant ion, a dipole field "excision" frequency is selected to correspond to the specific frequency of transverse motion that the undesired ion exhibits as it is guided down the quadrupole by the effective potential generated by the rf quadrupole voltage. This dipolar excision voltage (having a lower frequency than the rf quadrupole frequency) would coherently act to increase the transverse motion amplitude of the undesired ion as the ion traverses down the quadrupole. Eventually, the transverse motion amplitude becomes so large that the ion strikes the quadrupole structure and is eliminated from the ion beam. Other ions with different mass-to-charge ratios, due to their lack of synchronism with the excision frequency, would not increase their amplitudes in transverse motion significantly. In this manner, mass selectivity is achieved.

Thus, a notch filter is realized by operating a quadrupole in a rf-quadrupole-frequency-only configuration (i.e., no DC voltage, in which case the quadrupole acts effectively as an "ion pipe") and applying an oscillating dipolar excision voltage at a lower frequency than the rf quadrupole frequency to an opposing pair of the four quadrupole rods. Examples are found in Reinsfelder et al., "Theory and Characterization of a Separator Analyzer Mass Spectrometer," Int. J. Mass Spec. and Ion Physics, 37:241–250 (1981) and Miller et al., "A Notch Rejection Quadrupole Mass Filter," Int. J. Mass Spec. and Ion Physics, 96:17–26 (1990).

In such dipolar excision systems, the lower frequency dipolar excision voltage (creating a "dipole field") is applied to an opposing pair of the four quadrupole rods via an electronic coupling network. The reason such a coupling network is needed is that the higher frequency rf quadrupole voltage is applied such that any two adjacent electrodes are opposite in polarity, but the lower frequency excision voltage is applied such that the two oppositely facing electrodes to which this excision voltage is applied are opposite in polarity. Thus, the electronic coupling network is needed to isolate the excision voltage from the higher frequency rf quadrupole voltage. An example of such an electronic coupling network is described in "A Notch Rejection Quadrupole Mass Filter," Miller et al., supra (see FIG. 5 of Miller et al.). Such coupling networks require an additional radio frequency transformer to provide a means of isolating a single pair of rods out of the two pairs of quadrupole rods. The low frequency excision voltage is coupled via a primary winding on this transformer. This isolation scheme also requires the use of various radio frequency chokes and capacitors.

SUMMARY

The present invention provides a multinotch filter for selectively removing target ions with specific mass-to-charge ratios from an ion beam (e.g., a beam that contains a mixture of ions). This multinotch filter has a quadrupole and a power supply that drives the electrical potential (i.e., voltage) in the quadrupole. The quadrupole has two pairs of parallel electrodes. Each pair consists of two oppositely facing electrodes. The quadrupole has an inlet end and an outlet end; the ion beam is directed to traverse from the inlet end to the outlet end.

The multinotch filter has a power supply capable of generating an oscillating voltage which is a combination of (i.e., containing) a rf quadrupole frequency component and excision frequency components. The power supply is connected so that when a rf quadrupole voltage is applied to the quadrupole electrodes, within each pair of opposing electrodes (oppositely facing each other) the electrodes have the same voltage and the two pairs are 180° out of phase. The excision frequency components (i.e., oscillating excision voltages) are each applied between oppositely facing electrodes of one of the pairs. At least one excision frequency voltage is applied between one pair of oppositely facing electrodes and at least one other excision frequency voltage is applied between the oppositely facing electrodes of the other pair. With respect to each excision frequency voltage, the two oppositely facing electrodes of the pair connected thereto are opposite in polarity (i.e., 180° out of phase). For example, in a case with two excision frequencies, one excision frequency voltage is applied between one pair of opposing electrodes and the other excision frequency voltage is applied between the other pair of opposing electrodes. As used herein, when an oscillating voltage (e.g., rf excision voltage) is described as being applied between two electrodes, the resulting electrical potential of one electrode is 180° out of phase with the that of the other electrode based on the applied oscillating voltage.

Oscillation of voltage at the electrodes results in an effective force that affects the movement of ions in the ion beam. The effective force generated by the rf quadrupole voltage guides ions above a selected mass-to-charge ratio along the quadrupole from the inlet end to the outlet end. Each excision frequency voltage causes a different target ion (i.e., of a different specific mass-to-charge ratio) to resonate and be removed from the ion beam before exiting the quadrupole. Thus each excision frequency voltage creates a different "notch" or "rejection window" in the mass filter for a different target ion. The multinotch filter, using a plurality of excision frequency components (i.e. voltages), can remove target ions of a plurality of specific mass-to-charge ratios. A mass-to-charge ratio is also referred to as "mass" herein.

The present invention also provides a method for removing a plurality of unwanted target ions from an ion beam and a method of making a quadrupole multinotch filter that can accomplish such elimination of unwanted target ions.

A conventional quadrupole, with only a rf quadrupole voltage applied to the electrodes, acts as a high-pass mass filter (i.e., it allows ions of above a selected mass-to-charge ratio to pass while eliminating ions below that selected ratio). This selected ratio (or "cut-off" ratio) is determined by the frequency and the amplitude of the rf quadrupole voltage applied. When the cut-off ratio is selected to be below the lowest mass-to-charge ratio of interest in the ion beam, the quadrupole acts as a simple "ion pipe." The ions are guided down (or along) the quadrupole electrodes by an "effective potential" (which is generated by the rf quadrupole voltage and is directed toward the quadrupole centerline (along the axis)). The ions therefore travel down the axis of the quadrupole with transverse oscillations generated by the restoring forces of the effective potential. Such oscillating, "bouncing" paths are effectively harmonic. As used herein, when referring to the motion of an ion "along," "down," or "parallel" to the electrodes, it is understood that the motion may have transverse components, as will be described in the following.

For a particular ion, the effective potential is dependent partly on the mass-to-charge ratio of the ion traversing the quadrupole. As the ion (with a specific mass-to-charge ratio) moves down the quadrupole under the influence of the effective potential, it undergoes harmonic motion, hereafter called macromotion, in the transverse direction at a specific macromotion frequency. To eliminate a target ion according to the present invention, by applying an additional harmonic voltage (hereinafter called the excision frequency voltage) to the quadrupole at an excision frequency equal to the "macromotion" frequency, an oscillating electric field is created to provide a force that coherently causes the ion's macromotion to grow rapidly until the ion strikes an electrode. At the electrode, the ion is neutralized and thereby is eliminated from the ion beam. Ions with different macromotion frequencies are not significantly affected by the excision frequency voltage because the excision field does not act coherently to amplify the transverse macromotion of these ions.

The multinotch filter of the present invention is capable of removing target ions of a plurality of specific mass-to-charge ratios. Ordinarily, it would be preferable to minimize the complexity of a mass selective filter by reducing the number of electrical components used. Therefore, to make a multinotch mass filter, it would seem desirable to apply the multiple oscillating excision frequency voltages to a single pair of oppositely facing electrodes so that only one electronic coupling network is needed to isolate only that single pair of electrodes. However, we have found that by applying the different excision frequency voltages to different pairs of the oppositely facing electrodes, sharper and deeper notches can be realized. With the present invention, notches can be placed at two or more selected masses (i.e., mass-to-charge ratios) with, for example, one m/z width (m/z corresponds to the mass in amu divided by the integral number of electron charges of the ion of interest). Transmission suppression in a target notch can be set to allow much less than $10^{-3}$ transmission. The notch filter can allow full transmission (if not within other filtered ranges) outside of the notch.

BRIEF DESCRIPTION OF THE DRAWINGS

The following figures which show the embodiments of the present invention are included to better illustrate the present invention. In these figures, like numerals represent like features in the several views.

DETAILED DESCRIPTION OF THE PREFERRED EMBODIMENTS

This invention applies both low frequency excision voltages and a high frequency rf quadrupole voltage to two pairs of quadrupole rods (or electrodes). Multinotch filtration is achieved by applying these voltages to the rf quadrupole electrodes with voltage isolation so that the excision voltages are not directly superposed on the rf quadrupole voltage (i.e., the resulting voltage is not just the sum of the voltages). The rf quadrupole voltage is applied between two pairs of electrodes. Some (at least one) of the excision frequency voltages are applied to one pair of oppositely facing electrodes and some other (at least one) excision frequency voltages are applied to the other pair of oppositely facing electrodes.

Ion Motion Caused by rf Voltage on Quadrupole

Figure 1:
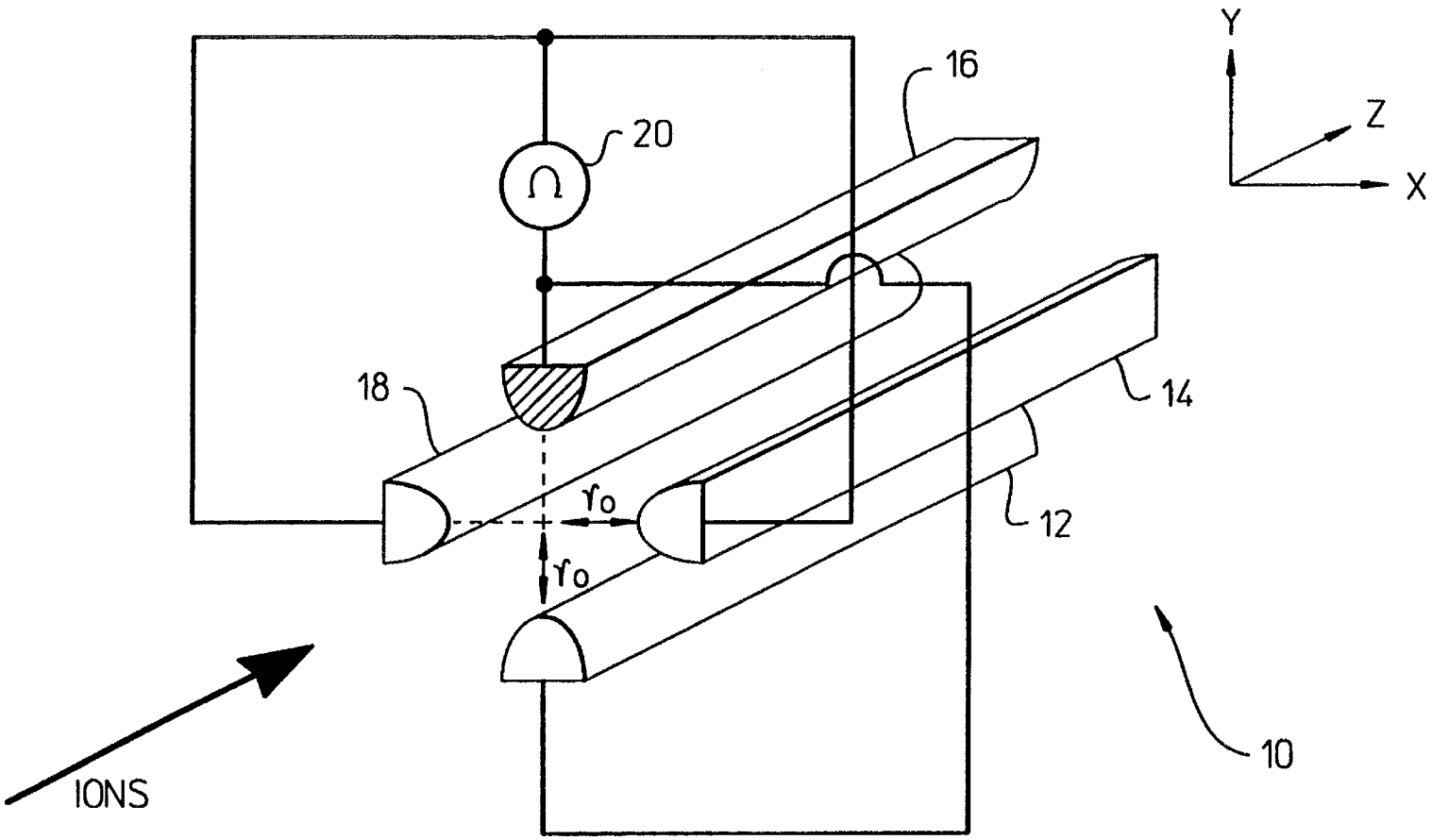
FIG. 1 (PRIOR ART)
FIG. 1 is a schematic representation of a prior art quadrupole.

The following provides a brief theoretical description relating to ion motion in a quadrupole. For the quadrupole structure depicted in FIG. 1, in an x, y, z Cartesian coordinate system, the voltage in the dimensions transverse to the z-axis has the form $$\Phi = \frac{\Phi_0}{r_0^2}(x^2 - y^2) \tag{1}$$

where $r_0$ is the distance from the quadrupole center axis to the nearest point on an electrode, and $\Phi_0$ is the applied voltage. Since the potential is invariant along the z-axis, the forces felt by an ion traveling along the quadrupole axis are only in the transverse dimensions. These forces are given by $$F = -e\nabla\Phi \tag{2}$$

where e is the charge on the ion. For an ion with mass m, equation (2) in Cartesian coordinates has the form $$m\frac{d^2x}{dt^2} = -e\frac{\partial\Phi}{\partial x} = -\frac{2e\Phi_0}{r_0^2}x \tag{3}$$

$$m\frac{d^2y}{dt^2} = -e\frac{\partial\Phi}{\partial y} = \frac{2e\Phi_0}{r_0^2}y. \tag{4}$$

For an applied potential (i.e., voltage) of the form $$\phi_0 U - V\cos(\Omega t) \tag{5}$$

where $\Omega$ is the angular velocity, U is the DC (direct current) component, and V is the amplitude of the AC (alternating current) component, the equations of motion for the transverse dimensions become $$\frac{d^2x}{dt^2} + \frac{2e}{mr_0^2}(U - V\cos(\Omega t))x = 0 \tag{6}$$

$$\frac{d^2y}{dt^2} - \frac{2e}{mr_0^2}(U - V\cos(\Omega t))y = 0. \tag{7}$$

Making the appropriate definitions and scaling the time variable allow these expressions to be written in the Mathieu equation canonical form $$\frac{d^2x}{d\xi^2} + (a - 2q\cos(2\xi))x = 0 \tag{8}$$

$$\frac{d^2y}{d\xi^2} - (a - 2q\cos(2\xi))y = 0 \tag{9}$$

where $$a = \frac{8e}{mr_0^2\Omega^2}U,\ q = \frac{4e}{mr_0^2\Omega^2}V,\ and\ \xi = \frac{\Omega t}{2}.$$

Figure 2:
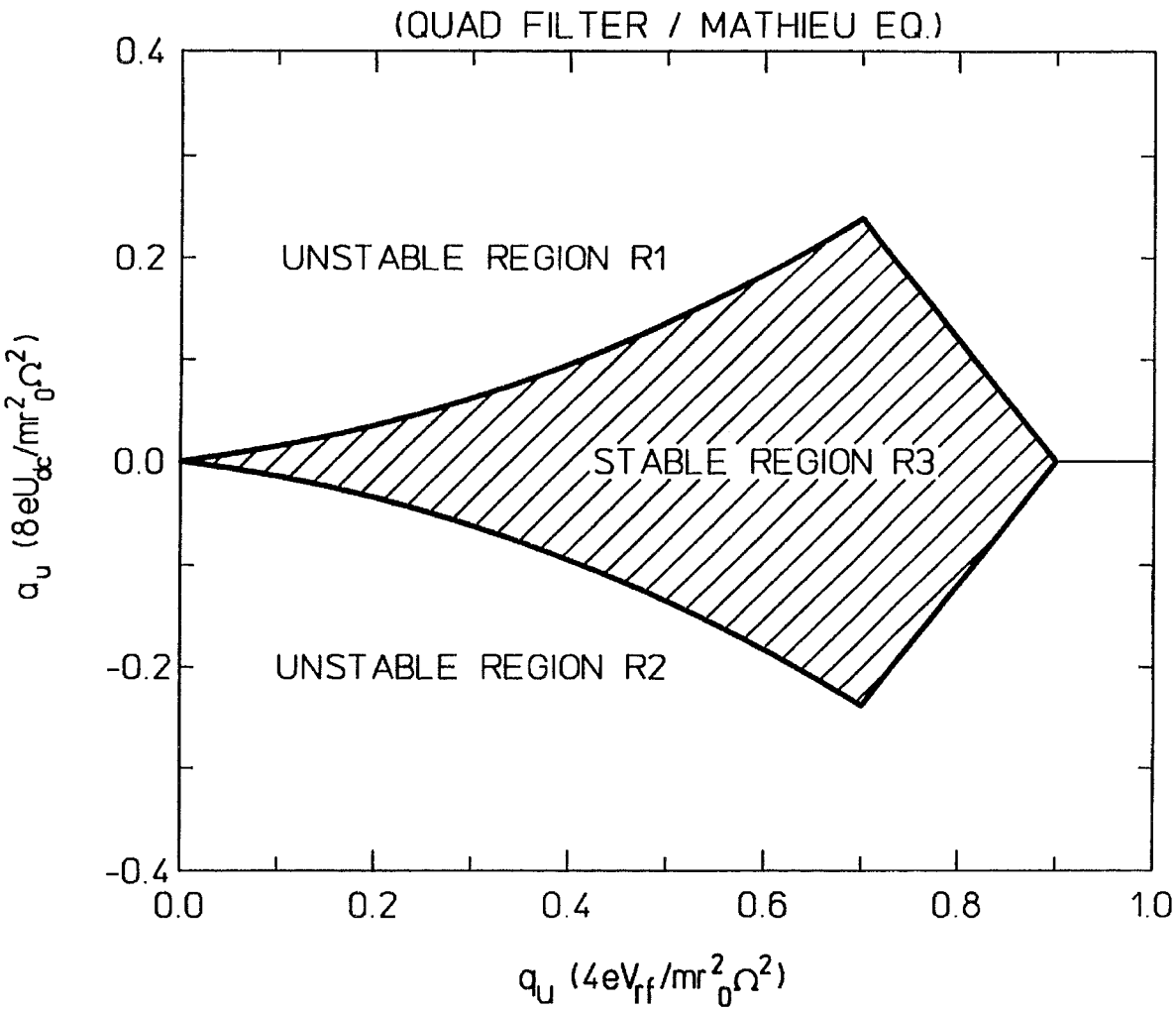
FIG. 2 is a graphical representation of the stability diagram of a quadrupole based on the Mathieu Equation.
Figure 3A:
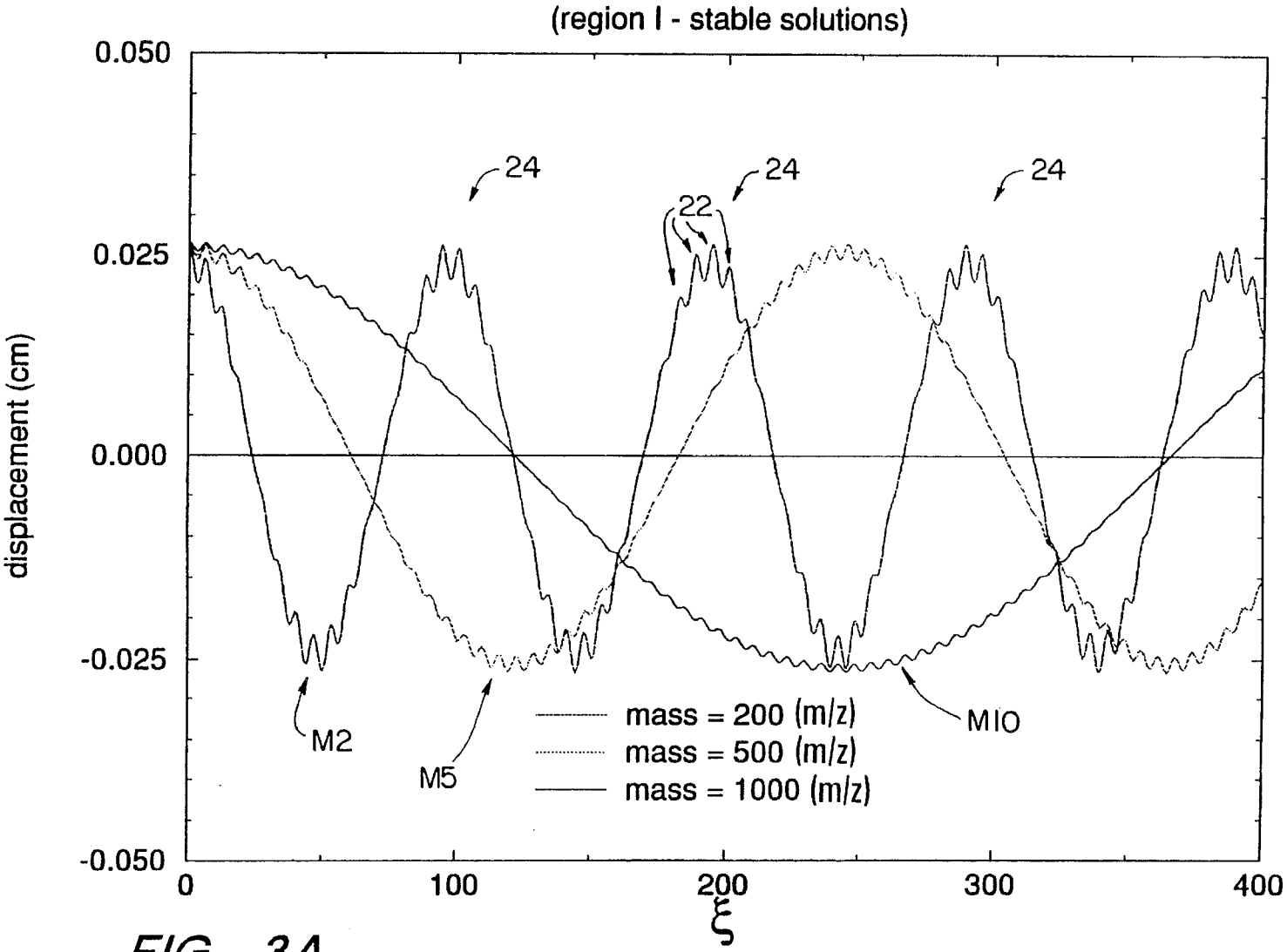
FIG. 3A is a graphical representation of the micromotion (22) and the macromotion (24) of ions of various masses (200 m/z, 500 m/z, 1000 m/z) in a quadrupole in the stable region of FIG. 2.
Figure 3B:
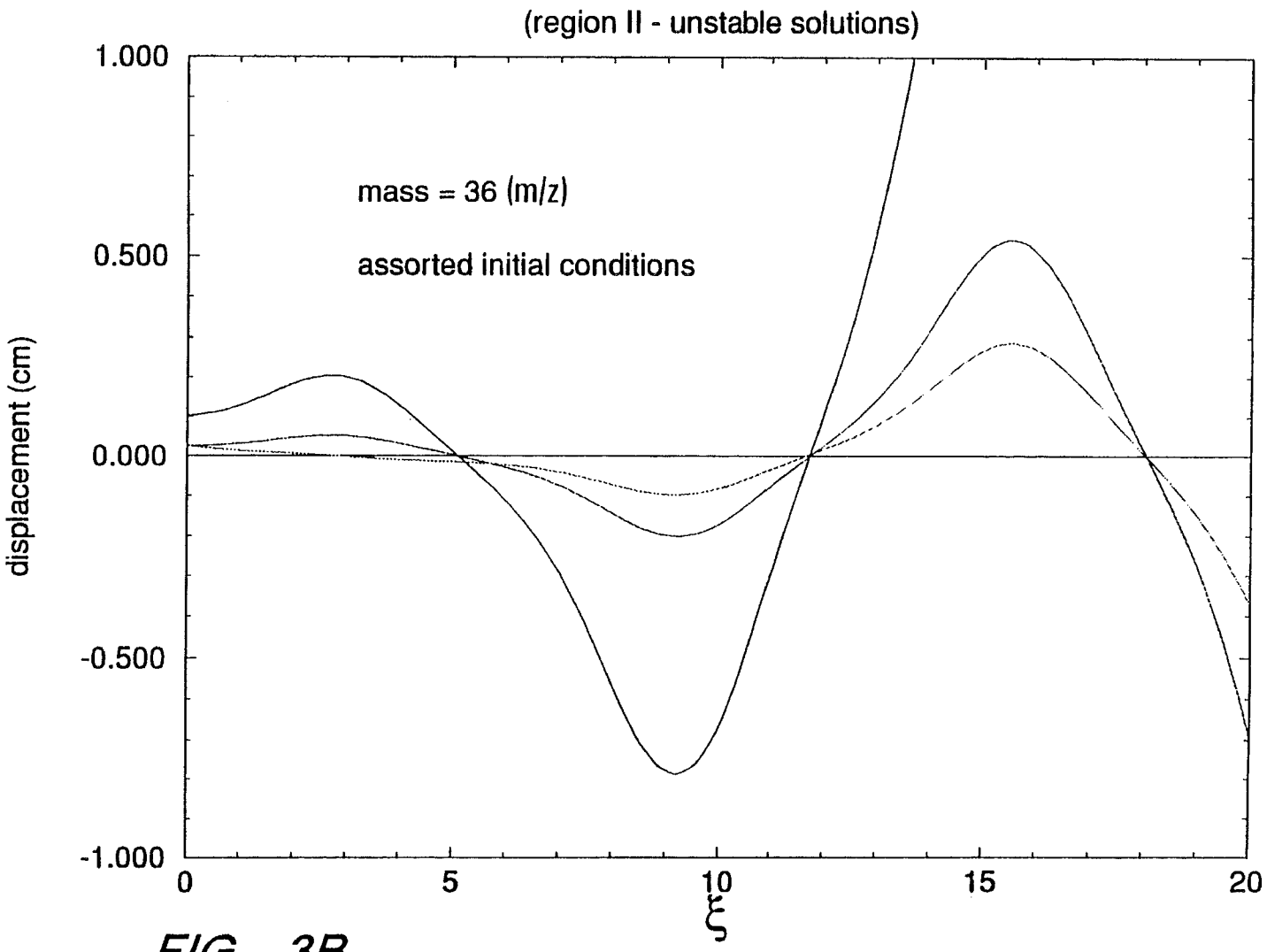
FIG. 3B is a graphical representation of the macromotion of ions of 36 m/z in the unstable region of FIG. 2 under various initial conditions.

The Mathieu equation is well understood, and the solutions can be qualitatively analyzed by inspection of the standard stability diagram shown in FIG. 2. FIG. 2 shows "unstable regions" R1, R2 and a "stable region" R3. For the parameters a and q in the stable region, the solutions to the Mathieu equation are finite, and are quasi-periodic in the time (or $\xi$) variable. For parameters lying outside this stable region, the solutions grow exponentially with time (or $\xi$), and are thus deemed unstable. FIGS. 3A and 3B show examples of numerically integrated solutions of the Mathieu equation for sets of parameters in the stable and unstable regions, respectively.

If the DC voltage is set equal to zero (U=0, then a=0) and the rf voltage is at a given nonzero amplitude and frequency, the stability of an ion's motion in the quadrupole depends on its mass-to-charge ratio. Since the parameter q varies as l/m, all ions with masses below a "mass cut-off" (selected mass-to-charge ratio, which depends on the actual values of V and $\Omega$) follow an unstable trajectory, and all ions with masses above the mass cut-off follow stable quasi-periodic trajectories.

If the parameters are chosen appropriately, i.e., with adequately low mass cut-off, a quadrupole operated with only a single applied rf voltage allows all ions that have a mass above a certain mass cut-off to pass through. In this way, as previously mentioned, it acts as a simple "ion pipe" for all ions with mass-to-charge ratios greater than the mass cut-off.

The quantitative behavior of the stable solutions to the Mathieu equation can be analyzed in the following way. The nonlinear nature of the interaction as dictated by the Mathieu equation generates a "static" effective potential for the ions by virtue of the small amplitude response of the ions to the rapid rf quadrupole field changes, hereinafter referred to as the "micromotion," and by the phase relationship to the applied rf quadrupole voltage. This "static" effective potential is what guides the ions down the axis of the quadrupole and causes the ions to undergo a much larger, slower "macromotion" oscillation superimposed upon the small, rapid micromotion generated by the applied rf quadrupole voltage. The frequency of this macromotion is calculable for an ion and depends on the amplitude and frequency of the applied rf quadrupole voltage and the ion's mass-to-charge ratio. The numerically integrated trajectories shown in FIG. 3A illustrate examples of the slow, large-amplitude macromotion (having peaks 24, etc. due to the effective potential) superimposed upon the more rapid, smaller-amplitude micromotion (having peaks 22, etc.). Curves representing motion of ions with mass-to-charge ratios 200 m/z (M2), 500 m/z (M5), and 1000 m/z (M10) are shown.

The stable solutions (trajectories) of the Mathieu equation as written above, in the approximation of the micromotion amplitude being much smaller than the macromotion amplitude, and averaging over time scales on the order of an rf period, have a transverse motion governed by the set of dynamical equations:

$$\frac{d^2x}{d\xi^2} + \left(a + \frac{q^2}{2}\right)x = 0 \tag{10}$$

$$\frac{d^2y}{d\xi^2} + \left(-a + \frac{q^2}{2}\right)y = 0. \tag{11}$$

For rf-quadrupole-frequency-only operation (a=0), the dynamical equations are simple harmonic in both transverse dimensions $$\frac{d^2x}{d\xi^2} + \frac{q^2}{2}x = 0 \tag{12}$$

$$\frac{d^2y}{d\xi^2} + \frac{q^2}{2}y = 0. \tag{13}$$

These equations show that the ions are guided along the quadrupole z-axis by an effective potential that exhibits a static linear restoring force toward the neutral position at zero offset.

From the above equations and the previous definitions of $\xi$ and q, the macromotion frequency (angular velocity) can be shown to be $$\omega_0 = \frac{q\Omega}{2\sqrt{2}} = \frac{\sqrt{2}\,e}{mr_0^2\Omega}\,V. \tag{14}$$

In the above approximation, the macromotion is purely harmonic (sinusoidal) for a specific rf quadrupole voltage V and a rf quadrupole frequency $\Omega$. The macromotion frequency varies as 1/m.

Preferred Embodiments of Quadrupole Multinotch Filter

Figure 4:
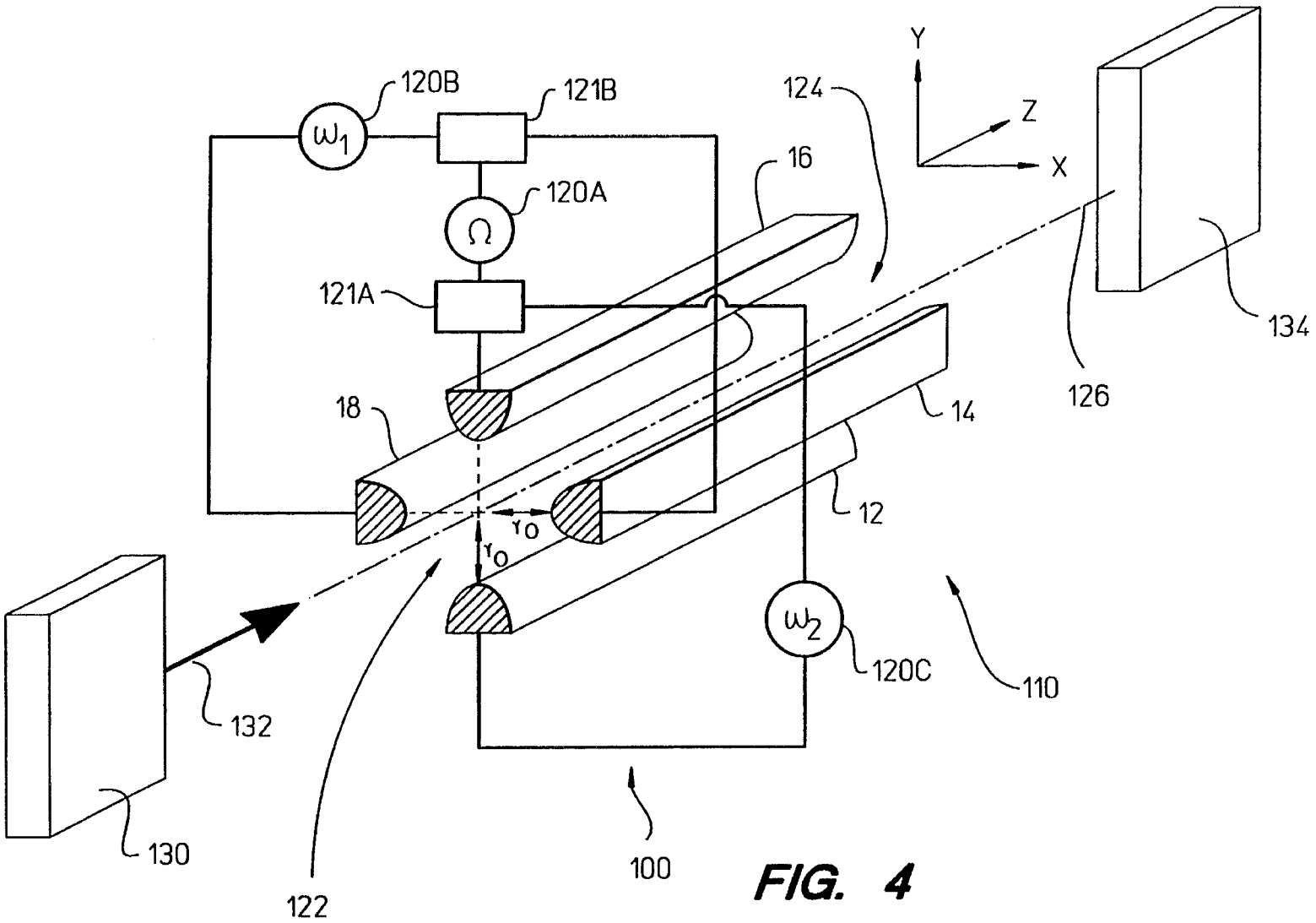
FIG. 4 is a schematic representation of an embodiment of the quadrupole multinotch filter of the present invention.

FIG. 4 shows an illustrative embodiment of the quadrupole multinotch filter 100 of the present invention. This quadrupole multinotch filter 100 can be used for selectively removing two target ions (i.e., a first and a second ion species, each with a different specific mass-to-charge ratio) from an ion beam. The quadrupole multinotch filter 100 includes a quadrupole electrode assembly 110 having two pairs of linear, parallel electrodes (or rods). Oppositely facing electrodes 12 and 16 are electrically connected together such that there is no substantial resistance between them (as a pair) with respect to a rf quadrupole frequency (at frequency $\Omega$) voltage applied between this pair and the other pair of oppositely facing electrodes 14, 18. Likewise, electrodes 14 and 18 are electrically connected together such that there is no substantial resistance between them with respect to the rf quadrupole frequency voltage. Each pair (e.g., electrode pair 12, 16), is 180° out of phase with the other pair (e.g., electrode pair 14, 18) with respect to the rf quadrupole frequency voltage. In this condition, the two pairs can be considered to be opposite in polarity.

An oscillating voltage (or power) supply (OVS) 120 (not pointed out separately in FIG. 4) drives the rf quadrupole frequency voltage (at frequency $\Omega$) as well as the excision voltages (at frequencies $\omega_1$ and $\omega_2$) of the quadrupole electrode assembly 110. In the voltage supply 120, oscillating voltage source 120A drives the rf quadrupole voltage (at frequency $\Omega$), oscillating excision voltage source 120B drives the first excision voltage (at frequency $\omega_1$), and oscillating excision voltage source 120C drives the second excision voltage (at frequency $\omega_2$).

Frequency selective electrical circuitry 121 is used to isolate the voltage source 120A from the excision voltage sources 120B and 120C (at frequencies $\omega_1$ and $\omega_2$ respectively). Oppositely facing electrodes 14, 18 are connected to a pole of the voltage source 120A via circuit 121B, which isolates the voltage source 120A from the first excision voltage (supplied by excision voltage source 120B at frequency $\omega_1$ between oppositely facing electrodes 14, 18). Oppositely facing electrodes 12, 16 are connected to the other pole of the voltage source 120A via circuit 121A which isolates the voltage source 120A from the second excision voltage (supplied by excision voltage source 120C at frequency $\omega_2$ between oppositely facing electrodes 12, 16). In this way, the power supply 120 generates oscillating voltages which are combinations of a rf quadrupole frequency component (i.e., at frequency $\Omega$) and first and second excision frequency components (i.e., at frequencies $\omega_1$ and $\omega_2$). Each of the excision frequencies are lower than the rf quadrupole frequency.

The quadrupole electrode assembly 110 has an inlet end 122 and an outlet end 124. The ion beam has a beam path 126 that extends from the inlet end 122 to the outlet end 124 of the quadrupole electrode assembly 110, parallel to the electrodes. As the voltages of electrodes 12, 14, 16, 18 oscillate, the effective potential generated by the rf quadrupole field causes ions above a selected mass-to-charge ratio (i.e., a "mass cut-off" ratio) to be guided down the quadrupole electrode assembly. The first excision field and second excision field cause the first target ion and the second target ion, respectively, to resonate and impact one of the electrodes 12, 14, 16, 18 before exiting the quadrupole multinotch filter 100.

In an assembly in which the quadrupole multinotch filter of the present invention is used for removing at least two target ions from an ion beam, the multinotch filter can further include an ion source 130 for emitting an ion beam (i.e., beam of ions) 132 into the quadrupole electrode assembly 110. Additionally, a detector 134 can be used for detecting the ions exiting the quadrupole electrode assembly 110. Ion sources and detectors suitable for such applications are known in the art. Electrodes, voltage supplies, oscillators, ion sources, and detectors suitable for use in quadrupoles and dipolar notch filters are known in the art (e.g., those described by Miller et al., supra, and Reinsfelder et al., supra, whose descriptions of quadrupole filter structures and the operation of the structures are incorporated by reference herein).

Figure 5:
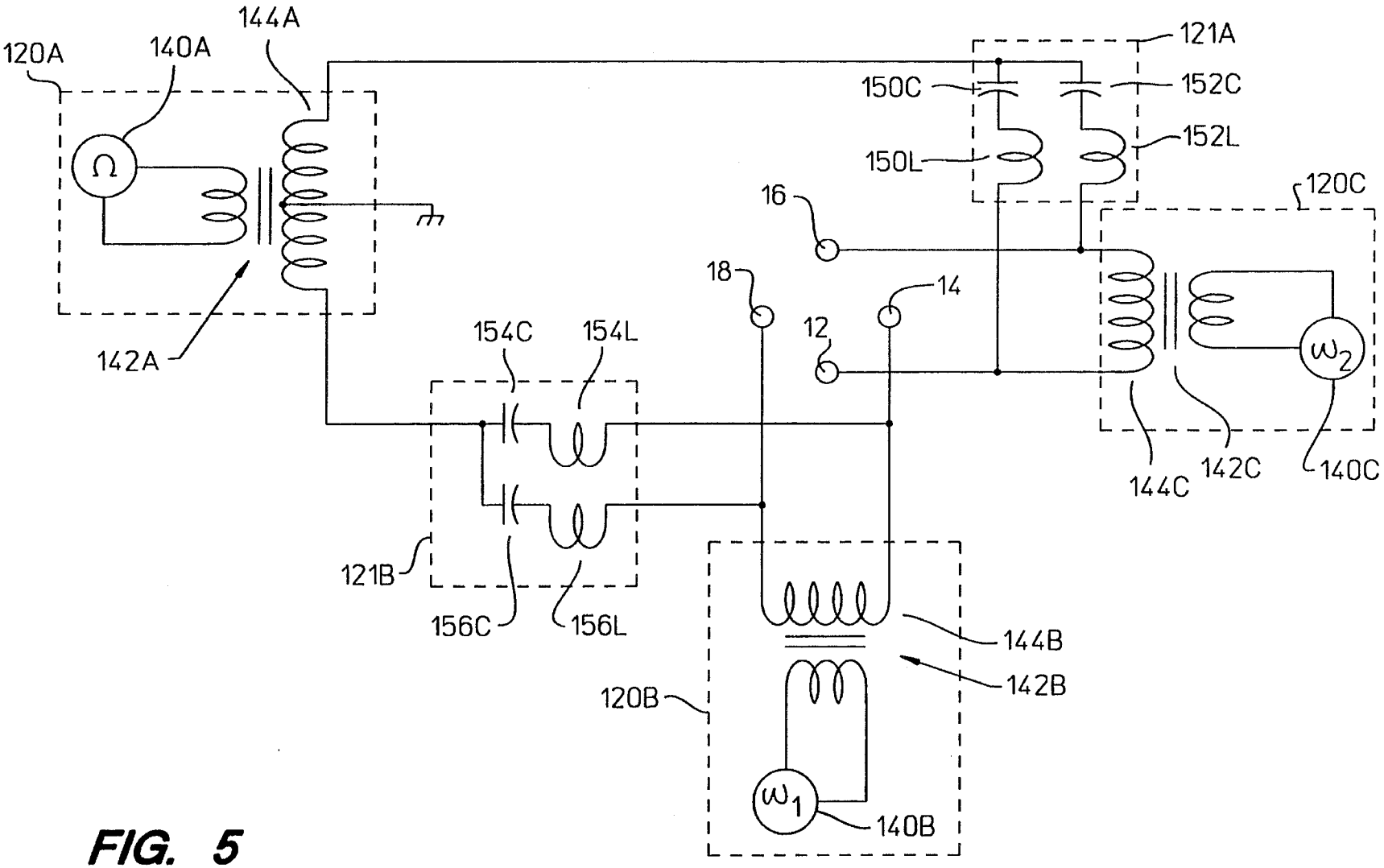
FIG. 5 is a schematic diagram showing the frequency selection isolation circuit for the multinotch filter of FIG. 4 according to the present invention.

FIG. 5 shows an illustration of an embodiment of the frequency selection isolation circuit according to the present invention for the multinotch filter of FIG. 4. This frequency selection isolation circuit is analogous to that shown in Miller et al., supra. From the present disclosure, a person skilled in the an will be able to modify the circuits of Miller et al., supra, to arrive at circuits for a multinotch filter. In FIG. 5, the voltage source 120A includes an oscillator 140A connected to transformer 142A for supplying the rf frequency quadrupole voltage (at frequency $\Omega$). One terminal of the output (i.e., secondary) coil of the transformer 142A is connected to the oppositely facing electrodes 12, 16 via isolation circuit 121A. In the isolation circuit 121A, a capacitor 150C and an inductive coil 150L are connected in series between output coil 144A and electrode 16. Similarly, a capacitor 152C and an inductive coil 152L are connected in series between output coil 144A and electrode 12. Capacitors 150C and 152C have the same capacitance and coils 150L and 152L have the same inductance (although other embodiments wherein the capacitors and inductive coils are not the same can be designed). Likewise, the other terminal of the output coil of the transformer 142A is connected to the oppositely facing electrodes 14, 18 via isolation circuit 121B. Like the isolation circuit 121A, isolation circuit 121B also has capacitors 154C, 156C and inductive coils 154L, 156L.

In the excision voltage source 120B, an oscillator 140B is connected to a transformer 142B (whose output coil 144B is connected between electrodes 14, 18 and, therefore, to isolation circuit 121B). Isolation circuit 121B thus interposes between the voltage source 120A and the voltage source 120B to isolate them from each other. Similarly, in the excision voltage source 120C, an oscillator 140C is connected to transformer 142C (whose output coil 144C is connected between electrodes 14, 18 and, therefore, to isolation circuit 121C). The values of the capacitance of the capacitors (150C, 152C, 154C, 156C) and inductance of the inductive coils (150L, 152L, 154L, 156L) are selected such that they can pass the rf frequency quadrupole voltage (at frequency $\Omega$) for application between electrode pair 14, 18 (the electrodes in the pair are equipotential relative to the rf quadrupole voltage) and electrode pair 12, 16 (the electrodes in the pair are equipotential relative to the rf quadrupole voltage). However, the isolation circuit 121B does not pass the first excision voltage (at frequency $\omega_1$) so that the voltage due to the first excision voltage source 120B is maintained between electrodes 14 and 18. Similarly, the isolation circuit 121A maintains the voltage due to the second excision voltage source 120C between electrodes 12 and 16. In this way, the excision voltages are superimposed on the rf frequency quadrupole voltage such that the excision voltages are applied between oppositely facing electrodes while the rf frequency quadrupole voltage is applied between adjacent (i.e., nonoppositely facing) electrodes.

Application of the Excision Fields

The quadrupole multinotch filter is operated to have the voltage of the electrodes oscillating at a selected rf quadrupole frequency $\Omega$ such that ions with a mass-to-charge ratio greater than a selected "mass cut-off" will be guided down the quadrupole (i.e., from the inlet end toward the outlet end). According to the present invention, the power supply further drives the electrodes to oscillate with excision voltages of frequencies $\omega_1$ and $\omega_2$ superimposed on the rf quadrupole voltage of frequency $\Omega$. The excision frequencies are selected to be at the macromotion frequencies of the target ions (i.e., the dominant resonant frequencies of the corresponding target ions in response to the effective potential) to be excised (removed from the ion beam).

Figure 6:
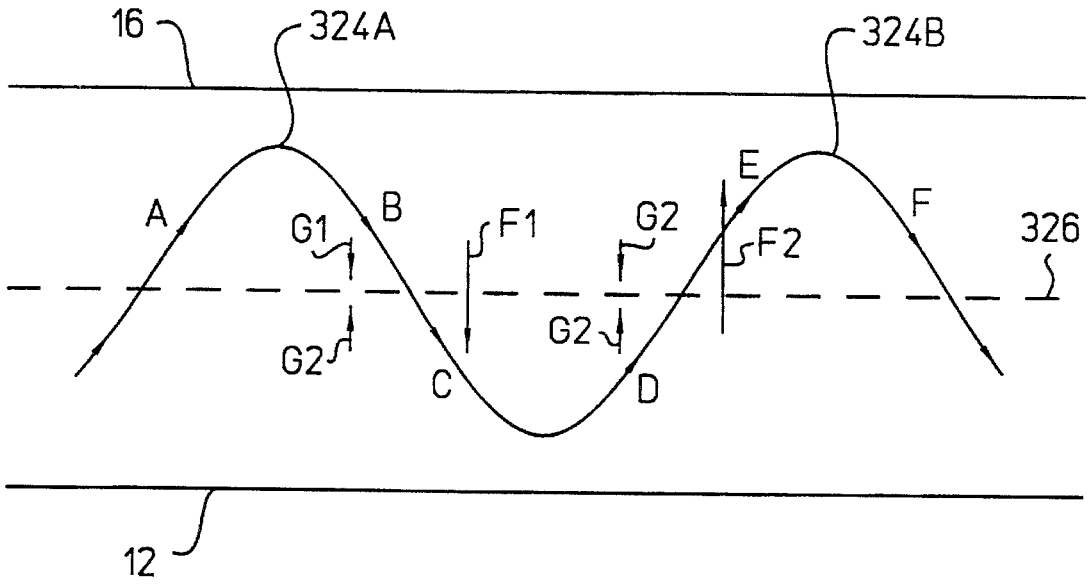
FIG. 6 is a schematic representation of the macromotion and the driving forces caused by an excision frequency voltage in a dipole field.

As the dipolar excision fields vary with frequencies that match the corresponding macromotion frequencies, the target ions oscillate in phase with the additional driving fields, and are thus driven from the ion beam. This process is illustrated by FIG. 6. For the sake of clarity, only one excision frequency (for removing one target ion) is described. It is understood that multiple excision voltages with different excision frequencies can be similarly implemented.

FIG. 6 is a schematic representation of the motion of an ion as it traverses down the quadrupole assembly. The excision field generates a force that, depending on the ion's location in the quadrupole, is either with or against the instantaneous transverse macromotion. As shown in FIG. 6, peaks 324A and 324B are peaks of the path (represented by curve ABCDEF) traversed by a target ion due to the macromotion caused by the effective potential generated by the rf quadrupole voltage. F1, F2, etc. are arrows representing the directions of forces generated by the dipole field of the excision voltage (e.g., between electrodes 12 and 16). At portions B and C of the macromotion path, the driving force (represented by arrow F1) from the electric field generated by the excision voltage (applied between electrodes 12 and 16) reinforces the macromotion and drives the ion away from electrode 16 towards electrode 12. At portions D and E of the macromotion path, the electric field generated by the dipolar excision voltage (applied between electrodes 12 and 16) now results in forces (represented by arrow F2) that also reinforces the (now reversed) ion macromotion, in a direction opposite to arrow F1.

A similar scheme of dipole field and forces is also present between electrodes 14 and 18 due to the rf quadrupole voltage and the other excision voltage (which is applied between electrodes 14, 18). In this way, by using excision frequencies each of which is at the macromotion frequency of a different target ion to be excised, the excision fields reinforce (are in synchronism with) the diverging (transverse) components of the target ions' macromotion, causing these transverse macromotions to grow. For each target ion, when the amplitude of the transverse macromotion becomes large enough, the target ion will strike an electrode before exiting the quadrupole and be eliminated from the ion beam.

The actual operation of a mass selective multinotch filter according to the present invention can be simulated using a computer program. To simulate the effect of the application of excision fields, terms $V_1^{ex}$ and $V_2^{ex}$ are added to the ion equations of motion, resulting in:

$$\frac{d^2x}{dt^2} + \frac{2e}{mr_0^2}(U - V\cos(\Omega t))\,x = \frac{2eV_1^{ex}}{mr_0^2}\cos(2\omega_1 t)\,x \tag{15}$$

$$\frac{d^2y}{dt^2} - \frac{2e}{mr_0^2}(U - V\cos(\Omega t))\,y = -\frac{2eV_2^{ex}}{mr_0^2}\cos(2\omega_2 t)\,y. \tag{16}$$

Figure 7A:
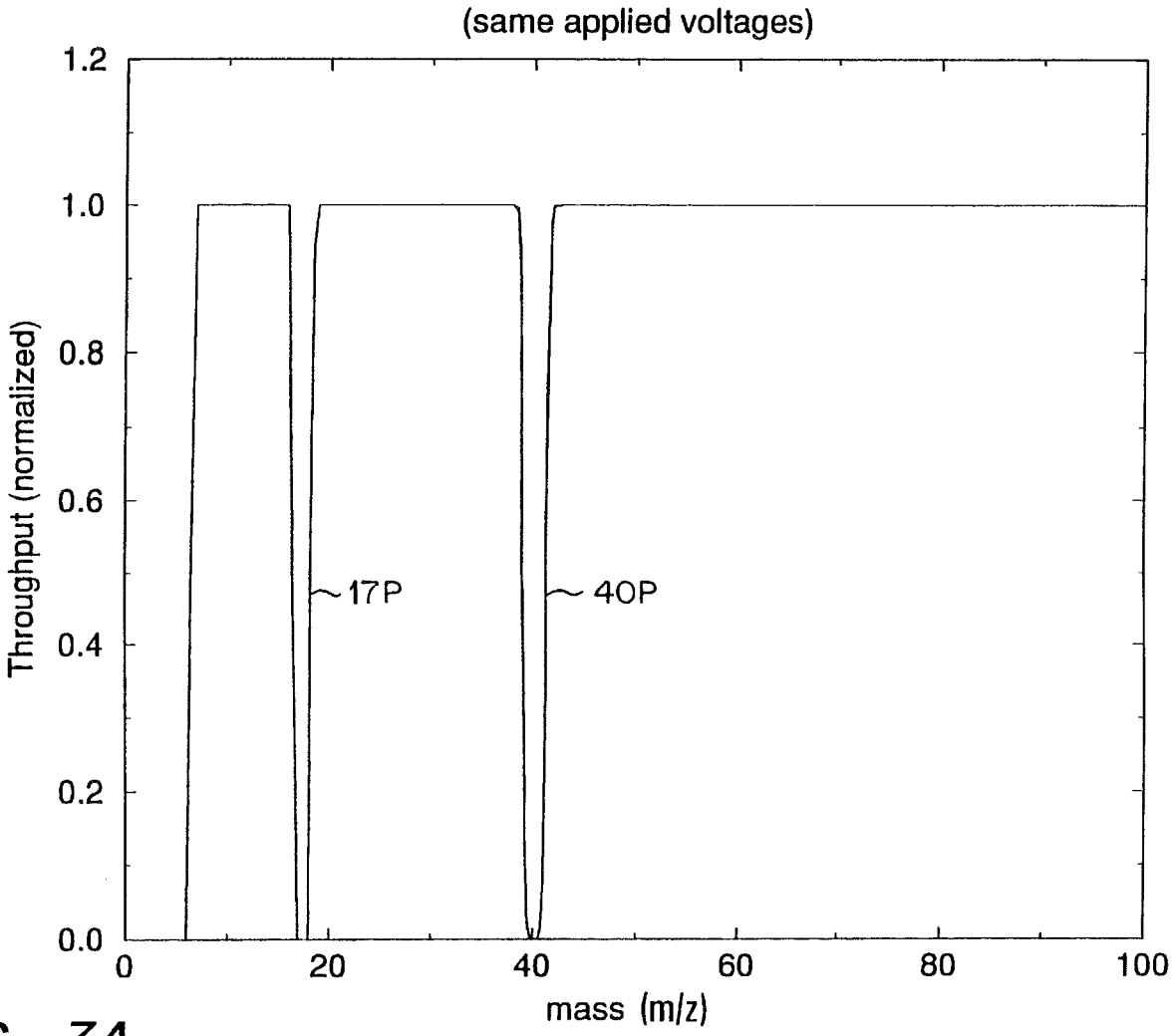
FIG. 7A is a graphical representation of the throughput of a quadrupole multinotch filter of the present invention showing the excision of two ion species.

$V_1^{ex}$ and $V_2^{ex}$ are the amplitudes of the applied excision fields. $\omega_1$ and to $\omega_2$ are the macromotion frequencies of the target ions to be "excised." FIG. 7A shows typical results of excision simulations. This quadrupole multinotch filter has a length of 15 cm. An excision field which has the frequency appropriate to eliminate ions with mass-to-charge ratio of 40 m/z and an excision field with the frequency appropriate to eliminate ions with mass-to-charge ratio of 17 m/z are applied to the quadrupole in an orthogonal manner according to the present invention. In this way, one excision voltage is applied to one pair of oppositely facing electrodes and the other excision voltage is applied to the other pair of oppositely facing electrodes (i.e., the dipole fields are in a perpendicular manner). This graph shows the throughput of the filter (i.e., the fraction of the ions of a particular mass-to-charge ratio that is transmitted). The filter provides excellent rejection in the transmission notches and full transmission of all non-targeted ions (i.e., it transmits all ions except those at the notches having specified mass-to-charge ratios of 17 m/z and 40 m/z, as illustrated by notch 17P and notch 40P, respectively).

Figure 7B:
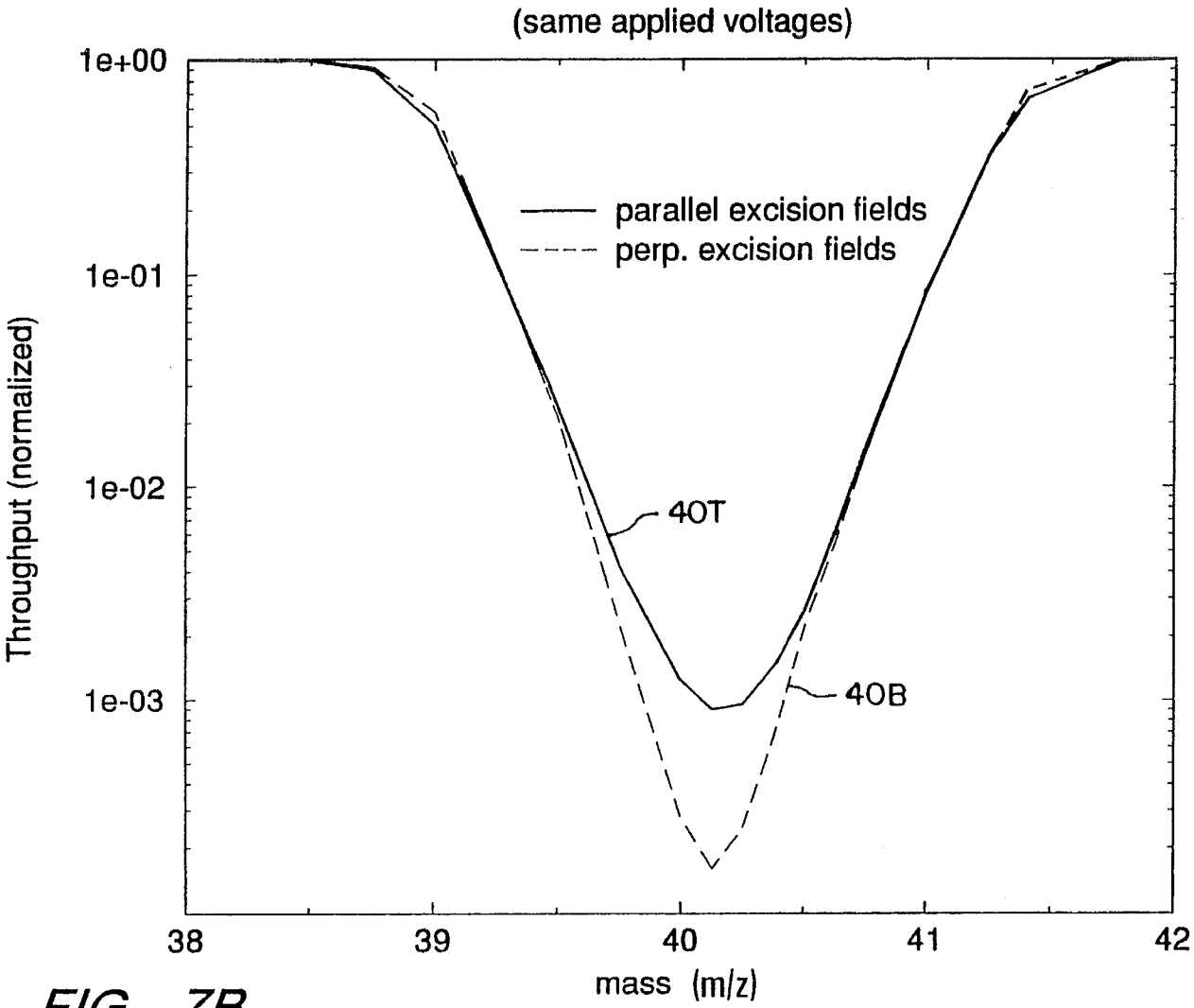
FIG. 7B is a graphical representation of the throughput of a quadrupole multinotch filter of the present invention showing further details of a portion of FIG. 7A and comparing with a filter with a parallel excision field configuration.
Figure 8:
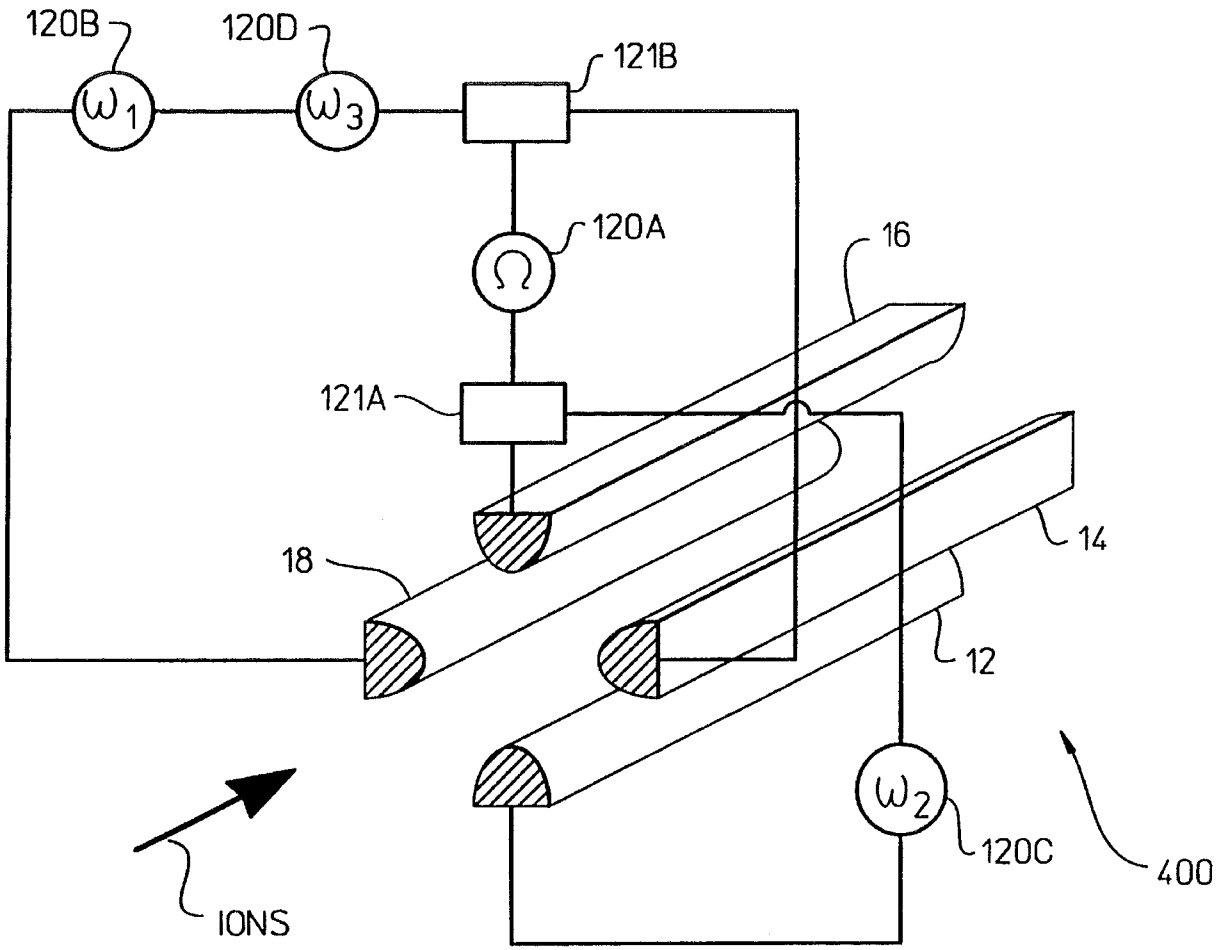
FIG. 8 is a schematic representation of an embodiment of a quadrupole multinotch filter of the present invention having three notches for the excision of three ion species.

FIG. 7B shows the 40 m/z notch of FIG. 7A in greater detail. For comparison with the results of FIG. 7A, which are for the orthogonal dipole excision field configuration, the solid curve 40T shows the throughput in a dual notch filter with "dipole fields in the parallel configuration," i.e., with both excision voltages being applied to the same pair of oppositely facing electrodes (and therefore having the dipole fields in parallel). Such a parallel dipole field configuration can be implemented by removing the excision voltage source 120C and frequency selection circuit 121A from the embodiment shown in FIG. 8, (FIG. 8 will be described later). The dashed curve 40B shows the throughput in a dual notch filter with orthogonal dipole fields (the same as the curve shown in FIG. 7A). We have found that the orthogonal dipole field configuration produces deeper notches that allows less throughput at the target mass than a parallel dipole field configuration. The orthogonal dipole field configuration is capable of producing less than $2\times10^{-4}$ throughput in the notches. The less effective nature of the notch in the parallel dipole field configuration is due to interference in the excision processes of the two parallel dipole excision fields. The theoretical description is provided to facilitate the understanding of the present invention. It is understood that the multinotch filter according to the present invention can be applied based on the present disclosure and does not depend on any particular theory.

Optimization of the Mass Selective Multinotch Filter

In the multinotch filter of this invention, the effective length of the filter is an important parameter to maximize. A longer interaction time allows the use of weaker excision fields to obtain the same notch depth (target ion rejection). Weaker excision fields yield a notch width that is smaller, since the nonresonant mass-to-charge ratios are less affected during their brief periods of synchronism with the excision fields as they go in and out of phase coherence. Performance is optimized by maximizing the effective length of the multinotch filter in the following ways:

(1) Maximize the physical length of the quadrupole structure. Commercial quadrupoles commonly exist with lengths on the order of 15 cm.

(2) Maximize the macromotion frequency. This increases the number of periods over which the excision field can work. This is done by first noting that a constraint is imposed by demanding the mass cut-off of the quadrupole be below the mass range of interest. The mass cut-off expression is obtained from the equation for the aforementioned parameter "q" and the stability diagram in FIG. 2. Since the boundary between stable and unstable trajectories occurs at q=0.909, the mass cut-off is given by $$m_{cut\text{-}off}=\frac{4e}{(0.909)r_0^2\Omega^2}\ V \tag{17}$$

which fixes the ratio between the amplitude and frequency of the rf voltage to achieve a specific mass cut-off value. Using this relation in the equation for the ion macromotion frequency yields $$\omega_0=0.321\left(\frac{m_{cut\text{-}off}}{m}\right)\Omega. \tag{18}$$

This shows that it is desirable to maximize the rf quadrupole frequency within the mass cut-off constraint to maximize the macromotion frequencies and thus the effective length of the multinotch filter.

Once the maximum rf quadrupole frequency achievable is chosen and the macromotion frequencies of the target (unwanted) mass-to-charge ratios are computed using the above equations, the excision fields can be applied at the macromotion frequencies. The value of the amplitude of the excision field is chosen to maximize the rejection in a notch, without broadening the width of the notch beyond the allowed one m/z/z (separation from the nearest "non-targeted" ion). This can be done for each of the target ions.

Since two or more target ion species (each with a different mass-to-charge ratio) can be excised simultaneously, an excision voltage can be added for each of the target ions, with the excision frequency corresponding to the individual macromotion frequency. In this case, preferably, excision voltages for neighboring (i.e., immediately adjacent) notches are applied to two different sets of oppositely facing electrodes in an orthogonal manner. For example, FIG. 8 shows the schematic representation of a multinotch filter 400 with three notches wherein $\omega_1$, $\omega_2$ and $\omega_3$ are excision frequencies corresponding to notches of increasing mass-to-charge ratios. The excision voltage sources for neighboring frequencies $\omega_1$ and $\omega_3$, are configured orthogonally, as are the excision voltage sources for neighboring frequencies to $\omega_3$ and $\omega_2$. The excision voltage sources for frequencies $\omega_1$ and $\omega_3$, however, are in a parallel configuration. It is understood that when more than three notches are to be implemented in the filter, the excision voltage sources can be arranged in an analogous manner.

Although the illustrative embodiments of the device of the present invention and the method of using the device have been described in detail, it is to be understood that the above-described embodiments can be modified by one skilled in the art, especially in sizes and shapes and combination of various described features without departing from the spirit and scope of the invention.

What is claimed is:

1. A multinotch filter for selectively removing from an ion beam at least two different target ions each with a different specific mass-to-charge ratio, comprising:

(a) a quadrupole having an inlet end and an outlet end so that the ion beam can be directed to traverse from the inlet end to the outlet end, the quadrupole having two pairs of parallel electrodes adapted to have oscillating voltages in the quadrupole, each pair having two oppositely facing parallel electrodes of equal voltage and one pair having oscillating voltage 180° out of phase with the other pair when a rf quadrupole voltage at a rf quadrupole frequency is applied between the two pairs of electrodes; and (b) a power supply electrically connected to the quadrupole for driving the oscillating voltage of the quadrupole, capable of generating an oscillating voltage which is a combination comprising the rf quadrupole voltage between the two pairs of electrodes, a first excision voltage at a first excision frequency between one pair of said oppositely facing electrodes, and a second excision voltage at a second excision frequency between the other pair of said oppositely facing electrodes, such that the rf quadrupole voltage causes ions of above a selected mass-to-charge ratio in the ion beam to be guided along the quadrupole from the inlet end to the outlet end, the first excision voltage causes a first target ion to resonate and be removed from the ion beam before exiting the quadrupole, and the second excision voltage causes a second target ion to resonate and be removed from the ion beam before exiting the quadrupole.

2. The multinotch filter according to claim 1 wherein each of said target ions has a different dominant resonant frequency in response to the rf quadrupole voltage and wherein the power supply is adapted to drive the quadrupole with excision voltages each of which having a frequency at a different dominant resonant frequency.

3. The multinotch filter according to claim 2 wherein any two of said excision voltages which are at two neighboring dominant frequencies are applied on two different pairs of said oppositely facing electrodes.

4. The multinotch filter according to claim 1 wherein the power supply has a plurality of oscillators for separately driving the rf quadrupole voltage and each of the excision voltages.

5. The multinotch filter according to claim 4 wherein frequency selective circuits are included to isolate the oscillator that drives the rf quadrupole voltage from oscillators that drive the excision voltages.

6. The multinotch filter according to claim 2 wherein more than two excision voltages are applied to the electrodes and wherein the power supply includes first, second, and third oscillators that drive first, second, and third excision voltages to remove first, second, and third target ions respectively, the first, second, and third target ions having neighboring dominant resonant frequencies in increasing order among all the target ions to be removed, said first and third oscillators each having voltage outlet terminals, the voltage outlet terminals of said first and third oscillators being connected in series to apply their excision voltages as a superposition between one pair of the oppositely facing electrodes, the second oscillator applying the second excision voltage between the other pair of the oppositely facing electrodes.

7. A multinotch filter for selectively removing from an ion beam at least two different target ions each with a different specific mass-to-charge ratio, comprising:

(a) a quadrupole having an inlet end and an outlet end so that the ion beam can be directed to traverse from the inlet end to the outlet end, the quadrupole having two pairs of parallel electrodes adapted to apply oscillating voltages to the quadrupole, each pair having two oppositely facing parallel electrodes of equal voltage and the two pairs are 180° out of phase in oscillating voltage when a rf quadrupole voltage at rf quadrupole frequency is applied between the two pairs of electrodes;

(b) an ion source for emitting an ion beam into the quadrupole;

(c) a power supply electrically connected to the quadrupole for driving the oscillating voltage of the quadrupole, capable of generating an oscillating voltage which is a combination comprising the rf quadrupole voltage between the two pairs of electrodes, a first excision voltage at a first excision frequency between one pair of said oppositely facing electrodes, and a second excision voltage at a second excision frequency between the other pair of said oppositely facing electrodes, such that the rf quadrupole voltage causes ions of above a selected mass-to-charge ratio in the ion beam to be guided along the quadrupole from the inlet end to the outlet end, the first excision voltage causes a first target ion to resonate and be removed from the ion beam before exiting the quadrupole, and the second excision voltage causes a second target ion to resonate and be removed from the ion beam before exiting the quadrupole, each of the different target ions having a different dominant resonant frequency in response to the rf quadrupole frequency component, wherein the power supply has a plurality of oscillators for separately driving the rf quadrupole voltage and each of the excision voltages, and wherein circuits are included to isolate the oscillator that drives the rf quadrupole voltage from each oscillator that drives an excision voltage; and (d) a detector for detecting the ions exiting the quadrupole.

8. A method for selectively removing from an ion beam at least two different target ions with different specific mass-to-charge ratios, comprising: driving the voltage of four parallel electrodes of a quadrupole as two pairs, each pair being 180° out of phase with the other pair when an oscillating rf quadrupole voltage is applied to the quadrupole such that each pair consists of two oppositely facing electrodes having the same voltage, driving the voltage between the oppositely facing electrodes of one of said pairs with a first excision voltage at a first frequency, and driving the voltage between the oppositely facing electrodes of the other of said pairs with a second excision voltage at a second frequency, the rf quadrupole frequency being selected to cause ions above a selected mass-to-charge ratio to be guided along the quadrupole, the first excision frequency being selected to cause the first target ion to resonate and be removed from the ion beam and the second excision frequency being selected to cause the second target ion to resonate and be removed from the ion beam before exiting the quadrupole, the ion beam being directed to traverse from an inlet end to an outlet end of the quadrupole.

9. The method according to claim 8 wherein the excision frequencies are selected such that for each of the different target ions (each having a different macromotion frequency in response to the rf quadrupole voltage) one of said excision voltages drives said target ion synchronously to amplify instantaneous transverse macromotion component of said target ion.

10. The method according to claim 8 wherein each of said different target ions has a different dominant resonant frequency in response to the rf quadrupole voltage, and wherein the frequencies of the excision voltages are selected to be at said different dominant resonant frequencies.

11. The method according to claim 8 further comprising maximizing the number of periods of oscillation that an ion undergoes before exiting the quadrupole.

12. The method according to claim 8 further comprising selecting a cut-off-mass-to-charge ratio and selecting a substantially maximal frequency for the rf quadrupole frequency within constraints of the cut-off mass-to-charge ratio selected.

13. The method according to claim 8 wherein different oscillators are used for driving the rf quadrupole voltage and the excision voltages.

14. The method according to claim 8 wherein different oscillators are used for driving the rf quadrupole voltage and each of the excision voltages and the method further comprising isolating the oscillator that drives the rf quadrupole voltage from the oscillators that drive the excision voltages.

15. The method according to claim 8 further comprising emitting an ion beam from an ion source.

16. The method according to claim 8 further comprising detecting ions exiting the quadrupole.

17. A method of making a multinotch filter for selectively removing from an ion beam at least two different target ions with different specific mass-to-charge ratios, comprising:

(a) connecting two parallel electrodes opposite each other as a first pair in a quadrupole to provide high frequency electrical communication therebetween and connecting two other parallel electrodes opposite each other as a second pair in the quadrupole to provide high frequency electrical communication therebetween; and (b) connecting a power supply to the quadrupole having four parallel electrodes consisting of two pairs of oppositely facing electrodes for driving an oscillating voltage on the quadrupole, the power supply being capable of generating an oscillating voltage which is a combination comprising a rf quadrupole voltage which results in equipotential on the oppositely facing electrodes in each pair and results in a pair being 180° out of phase with the other pair with respect to the rf quadrupole voltage, the power supply further being capable of generating a first excision voltage at a first excision frequency between one pair of said oppositely facing electrodes such that the electrodes within said pair are 180° out of phase with each other with respect to the first excision voltage, and capable of generating a second excision voltage at a second excision frequency between the other pair of said oppositely facing electrodes such that with respect to the second excision voltage the electrodes within said other pair are 180° out of phase with each other, such that the rf quadrupole voltage generates a field to result in ions above a selected mass-to-charge ratio being guided along the quadrupole, the first excision voltage causing a first target ion to resonate and be removed from the ion beam, and the second excision voltage causing a second target ion to resonate and be removed from the ion beam before exiting the quadrupole, the ion beam being directed to traverse from an inlet end to an outlet end of the quadrupole.

18. The method according to claim 17 wherein different oscillators are connected for driving the rf quadrupole voltage and for driving each of the excision voltages; and the method further comprising isolating with frequency selective coupling circuits the oscillator that drives the rf quadrupole voltage from the oscillators that drive the excision voltages.

* * * * *